US007094959B2

(12) United States Patent
Marnell

(10) Patent No.: US 7,094,959 B2
(45) Date of Patent: Aug. 22, 2006

(54) ALTERNATING CYMBALS

(76) Inventor: Stephen P. Marnell, 436 White Schoolhouse Rd., Rhinebeck, NY (US) 12572

( * ) Notice: Subject to any disclaimer, the term of this patent is extended or adjusted under 35 U.S.C. 154(b) by 225 days.

(21) Appl. No.: 10/929,646

(22) Filed: Aug. 30, 2004

(65) Prior Publication Data

US 2006/0042451 A1 Mar. 2, 2006

(51) Int. Cl.
*G10D 13/02* (2006.01)

(52) U.S. Cl. ..... 84/422.3; 84/422.1

(58) Field of Classification Search ..... 84/422.1, 84/422.3, 422.2, 421
See application file for complete search history.

(56) References Cited

U.S. PATENT DOCUMENTS 3,167,995 A 2/1965 La Londe
4,111,095 A 9/1978 Simons
4,177,709 A 12/1979 Adams
4,274,322 A 6/1981 Cordes
6,331,667 B1 12/2001 Kuppers
6,977,333 B1 * 12/2005 Sutej ..... 84/422.3
2005/0150355 A1 * 7/2005 Sutej ..... 84/422.3
2005/0155482 A1 * 7/2005 Takagawa ..... 84/422.1

* cited by examiner

*Primary Examiner*—Gary F. Paumen

(57) ABSTRACT

Alternating Cymbals utilize two pairs or sets of cymbals, a first pair and a second pair of cymbals, which play alternately with a single actuation usually by a foot pedal. Both sets of cymbals are supported by a support means which includes a tripod, column with a bracket extending from the column. The first pair of cymbals are mounted at the upper end of the column. A shaft in the column pulls the top cymbal of the first pair of cymbals down against the bottom cymbal of the first pair of cymbals. The second pair of cymbals are mounted on the bracket. A rod is connected to the shaft and the bottom cymbal of the second set of cymbals which is mounted on the rod strikes the top cymbal of the second pair of cymbals when the foot pedal is released. A spring about the shaft moves the shaft and rod upwardly when the foot pedal is released.

9 Claims, 7 Drawing Sheets

ALTERNATING CYMBALS

BACKGROUND OF THE INVENTION

1. Field of the Invention

This invention relates to a percussion instrument, namely cymbals which are usually played in conjunction with drums, and more specifically, relates to two separate pairs of cymbals that play alternately, with one movement of an actuating device, usually a foot pedal.

2. Prior Art

Cymbals and deices for playing cymbals are known. A pair or set of cymbals as used herein refers to two cymbals that engage one another to produce sound. Each cymbal can be any form of percussion device. A single pair of cymbals on a stand, often referred to as a "high hat," is known and commercially available. The La Londe Patent, U.S. Pat. No. 3,167,959, teaches such a device.

The Simons Patent, U.S. Pat. No. 4,111,095, teaches the use of two pairs of cymbals, one above the other, which are played simultaneously, but not alternately.

The Cordes Patent, U.S. Pat. No. 4,274,322, which purports to be an improvement over the Simons Patent just previously discussed, places two pairs of cymbals side by side rather than one over the other, as taught by Simons. However, with Cordes, like Simons, the two sets or pairs of cymbals are played simultaneously and are not played alternatively.

The simultaneous actuation of two sets of cymbals does offer an advantage to a percussionist, but the alternate striking of two pairs of cymbals in close succession also offers an advantage to a percussionist. The second engagement occurs, in accordance with this invention, immediately after the first engagement. To achieve this with two separate high hats would be virtually impossible for a player to achieve. It should also be noted that two sets of cymbals striking simultaneously can be utilized with the present invention in place of either one or both sets of the cymbals that are sounded alternately.

Objects

The objects of this invention are as follow:

To provide a device for playing two separate sets of cymbals alternatively with one activation.

To provide a device which can be attached to an existing "high hat" to provide two separate sets of cymbals which are played alternatively with one actuation.

To provide two pairs of cymbals that are alternatively actuated by a single actuation and which are dependable and economical.

These and other objects of the present invention will become readily apparent upon further review of the following specification and drawings.

SUMMARY OF THE INVENTION

Alternating Cymbals are provided utilizing a first pair of cymbals and a second pair of cymbals. Each pair of cymbals has a top cymbal and bottom cymbal. Both pairs of cymbals are supported by a support means. The bottom cymbal of the first pair of cymbals and the top cymbal of the second set of cymbals are mounted on the support means. The top cymbal of the first pair of cymbals and the bottom cymbal of the second pair of cymbals are mounted to move on the support means. Actuating means move the top cymbal of the first pair of cymbals to strike the bottom of the first pair of cymbals, while moving the bottom cymbal of the second pair of cymbals away from the top cymbal of the second pair of cymbals. Similarly, the actuating means moves the top cymbal of the first pair of cymbals away from the bottom cymbal of the first pair of cymbals, while moving the bottom cymbal of the second pair of cymbals toward the top cymbal to strike the top cymbal of the second pair of cymbals.

DETAILED DESCRIPTION OF THE DRAWINGS

DESCRIPTION OF THE NUMERALS
ALTERNATING CYMBALS

| NUMERAL | DESCRIPTION |
|---|---|
| 11 | TWO SECTIONS |
| 13 | HIGH HAT SECTION |
| 15 | HIGH HAT SET OF CYMBALS |
| 17 | ALTERNATE SECTION |
| 19 | ALTERNATE OR SECOND PAIR OF CYMBALS |
| 21 | TRIPOD |
| 23 | COLUMN |
| 25 | COUPLINGS |
| 27 | UPPER END |
| 29 | LOWER END |
| 31 | OPENING |
| 33 | SHAFT |
| 35 | UPPER SECTION |
| 37 | LOWER SECTION |
| 39 | THUMB SCREW |
| 41 | YOKE |
| 43 | UPPER END |
| 45 | LOWER END |
| 47 | CLAMP |
| 49 | CHAIN |
| 51 | FOOT PEDAL |
| 53 | LOWER END |
| 55 | TOP CYMBAL |
| 57 | BOTTOM CYMBAL |
| 59 | RETAINING COLLAR |
| 61 | FELT WASHER |

-continued

| DESCRIPTION OF THE NUMERALS ALTERNATING CYMBALS | |
|---|---|
| NUMERAL | DESCRIPTION |
| 63 | NUT |
| 65 | UPPER END |
| 67 | COUPLING |
| 69 | THUMB SCREW |
| 71 | NUT |
| 73 | RETAINING MEMBER |
| 75 | ROD |
| 77 | TURN SCREW |
| 79 | INNER SECTION |
| 81 | MIDDLE SECTION |
| 83 | OUTER SECTION |
| 85 | BRACKET |
| 87 | OUTER END |
| 89 | PAIR OF RETAINERS |
| 91 | OUTSIDE END |
| 93 | INSIDE END |
| 95 | CONNECTOR |
| 97 | TURN SCREW |
| 99 | BOTTOM RETAINER |
| 101 | BOTTOM CYMBAL |
| 103 | ROD EXTENSION |
| 105 | SPRING |

DETAILED DESCRIPTION OF THE PREFERRED EMBODIMENT

Figures 1, 1A:
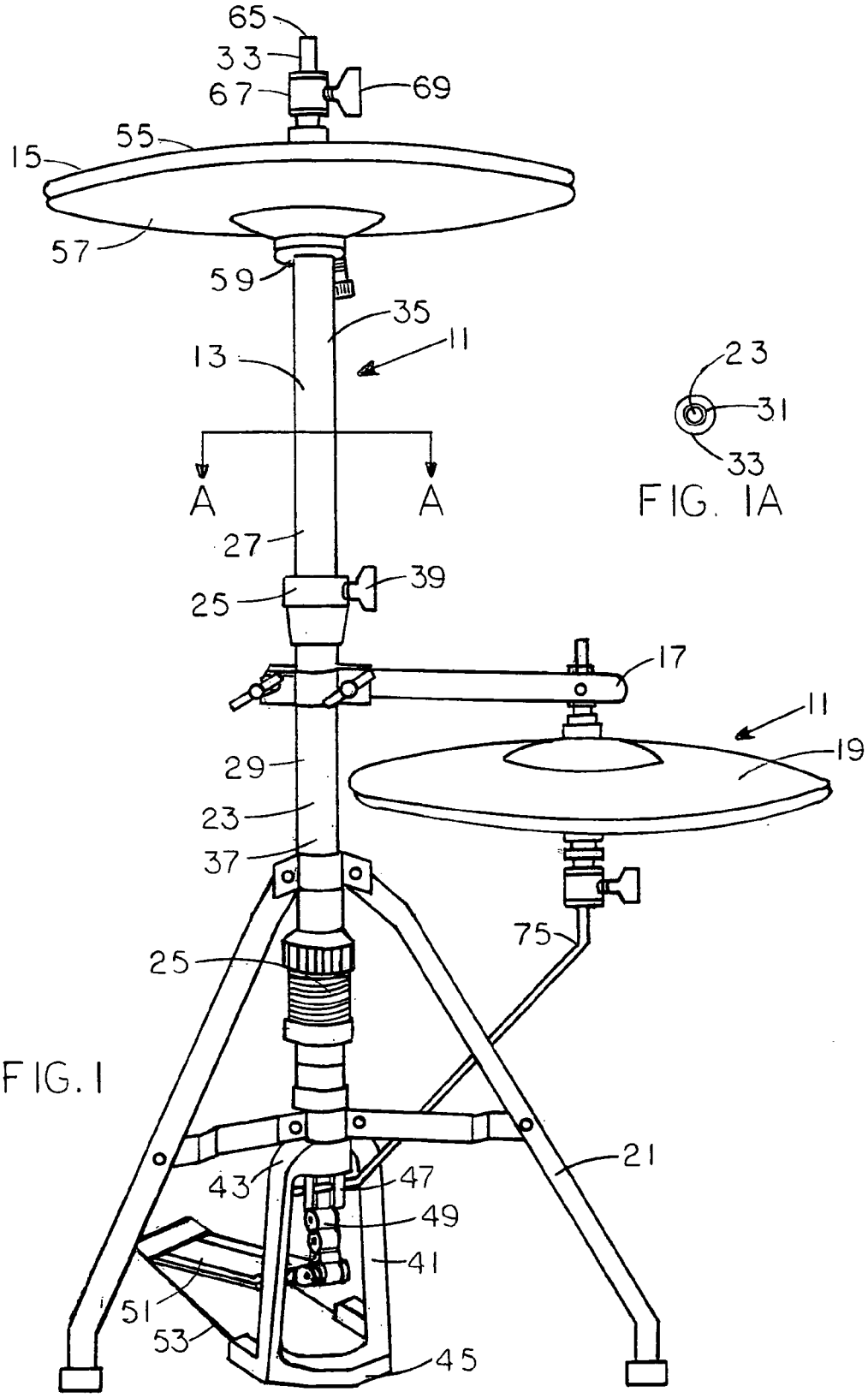
FIG. 1 is a pictorial view of a pedal actuated pair of cymbals, that is a referred to as a "high hat" with another pair of cymbals mounted on the high hat to be sounded alternately.
FIG. 1A is a cross-sectional view along line A—A of FIG. 1.

Referring to FIG. 1, the Alternating Cymbals have two sections 11, namely a high hat section 13, that plays at least one pair of high hat or first cymbals 15, and an alternate section 17, that plays at least one pair of alternate or second cymbals 19.

The high hat section 13, absent the alternate section 17, is a commercially available cymbal player. Therefore, detailed description of the high hat section 13 is not necessary except to provide an understanding of the high hat section 13 in relation to the alternate section 17.

The high hat section 13 is constructed on a stand which is usually a tripod 21. The tripod 21 folds together for ready transportation and storage. Centrally mounted on the tripod 21 is a column 23 which is generally vertical. The column 23 includes couplings 25 which permit length adjustment and disassembly of the column 23.

The column 23 has an upper end 27 and a lower end 29 and the column 23 also has a opening 31 through it, preferable concentrically located within the column. A shaft 33 is mounted to slide within the column 23. Toward the upper end 27, the column 23 has an upper section 35 and toward the lower end 29, the column 23 has a lower section 37. A thumb screw 39 is used to adjust the height of the upper end 27 of the column 23 by securing the upper section 35 which slides in the lower section 37.

Figure 4:
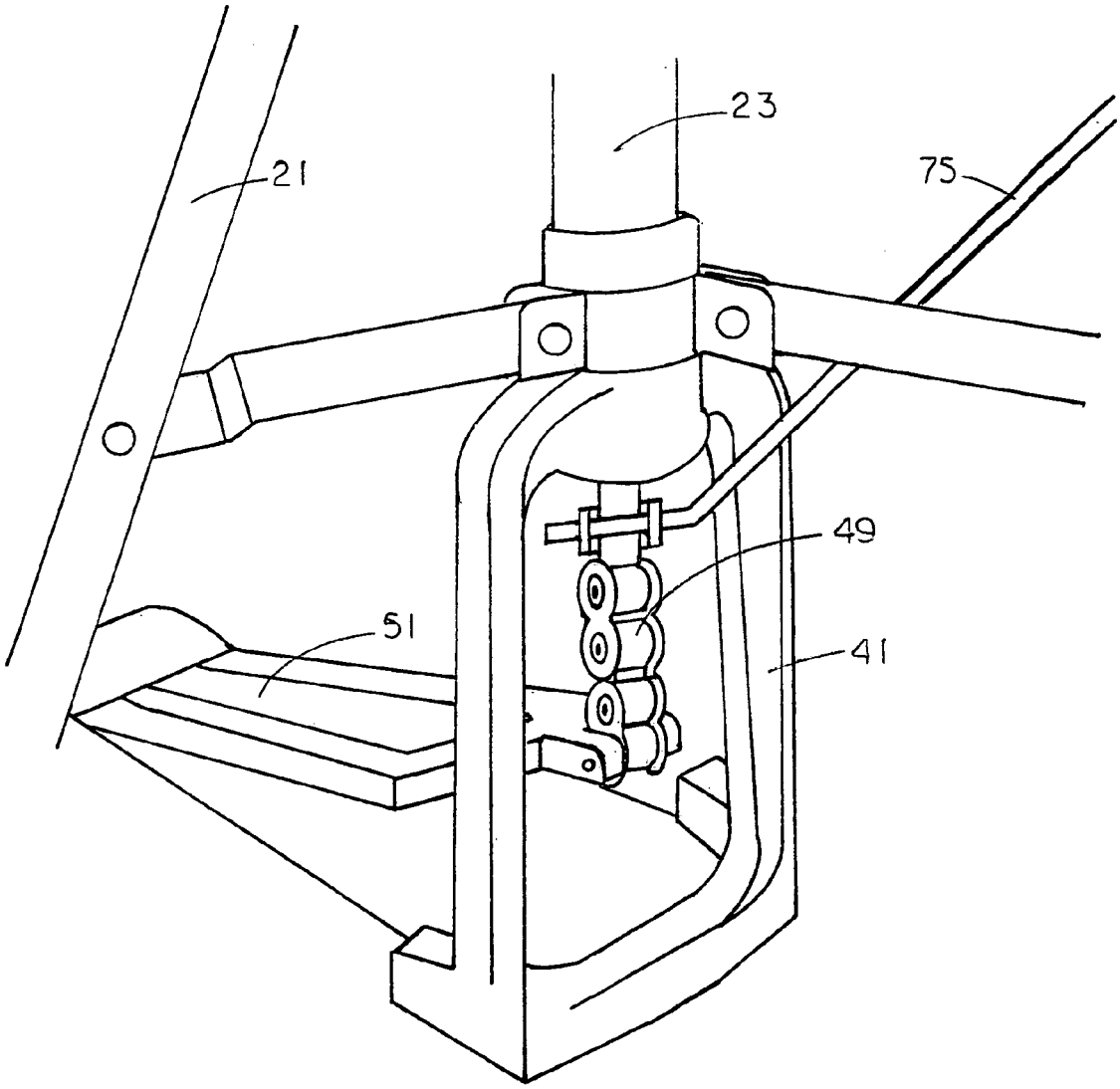
FIG. 4 is an enclosed perspective view of the front and side of the foot pedal and connecting chain showing the connection of the rod for the alternate or second pair of cymbals of the high hat connected to the shaft for activating the upper pair of cymbals of the high hat.

The column 23 (FIG.1) is supported by the tripod 21 and by a yoke 41 which rests upon the ground. The yoke 41 has an upper end 43 which is connected to the column 23 and a lower end 45 which rests upon the ground. The shaft 33 extends outside the column 23 into the yoke 41. A clamp 47 (FIGS. 1 and 4) is affixed to the shaft 33 inside the yoke 41. A chain or extension member 49 extends within the yoke 41 from the shaft 33 toward the lower end 45 of the yoke 41. A foot pedal 51 has a lower end 53 which supports the foot pedal 51 on the ground and is inclined upwardly into the yoke 41. The chain 49 is secured to the foot pedal 51 within the yoke 41 so that when the foot pedal 51 is depressed, the shaft 33 is pulled down within the column 23. The high hat section 13 includes the high hat or first pair of cymbals 15, including a top cymbal 55 and a bottom cymbal 57. The bottom cymbal 57 is mounted on the upper end 27 of the column 23 by a retaining collar 59 (FIG. 1) mounted on a felt washer 61. The felt washer 61 is located between the bottom cymbal 57 and the retaining collar 59. Above the bottom cymbal 57 of the high hat section 13, there is a felt washer 61 mounted against the bottom cymbal 57 and a nut 63 is mounted against the felt washer 61 above the bottom cymbal 57. The numeral "61" is used for all felt washers shown. The shaft 33 slides in the bottom cymbal 57 of the high hat set of cymbals 15. The top cymbal 55 of the high hat set of cymbals 15 is secured to the shaft 33 and is also held between a pair of felt washers 61. Various approaches have been used to mount cymbals 15 so as to produce resonance. These features are essential to the operation of the invention but are not part of the actual invention.

Figure 7:
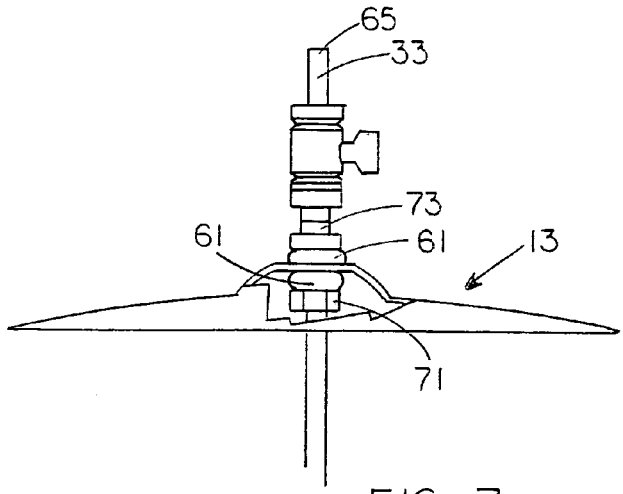
FIG. 7 is a side elevation, partially broken away, of the top cymbal of the high hat pair of cymbals.
Figure 8:
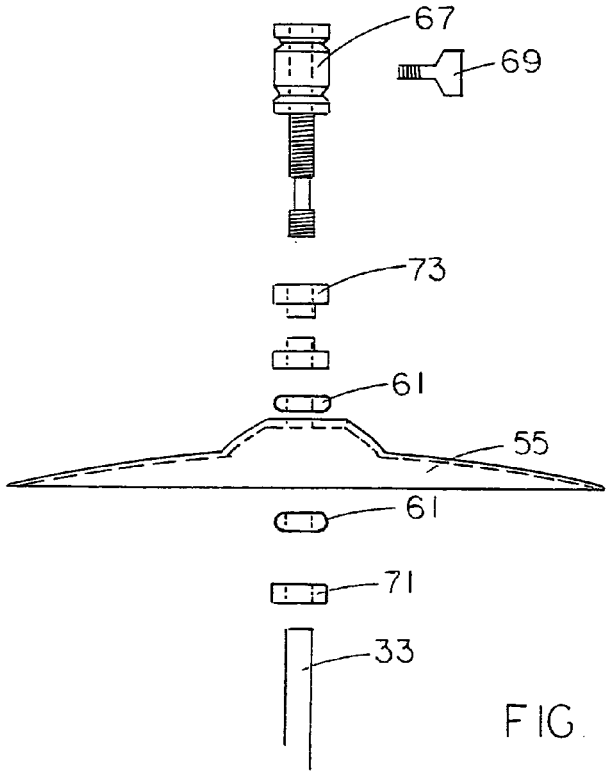
FIG. 8 is an exploded side elevation of the top cymbal of the pair of high hat cymbals.

In FIGS. 7 and 8, the top cymbal 55 of the first or high hat section 13 is shown. In FIG. 7 the top cymbal 55 is shown mounted on the shaft 33 and in FIG. 8 the top cymbal 55 and shaft 33 are shown in exploded form. FIG.7 and FIG. 8 illustrate, in a general manner, retaining cymbals 15 including those in the second or alternate section 19.

The shaft 33 is shown above the top cymbal 55 and below the top cymbal 55. The shaft 33 slides within the bottom cymbal 57 of the high hat section 13. The shaft 33 is threaded at its upper end 65: A coupling 67 with a thumb screw 69 is mounted at the upper end 65 of the shaft 33. As best seen in FIG. 7, a nut 71, threaded on the shaft 33 and a felt washer 61, is placed on the nut 71. The top cymbal 55 is placed on the felt washer which is over the nut 71. Then another felt washer 61 is placed on the top cymbal 55 and a pair of retaining members 78 are threaded onto the shaft 33 to force the pair of felt washers 61 against the top cymbal 55.

Figure 5:
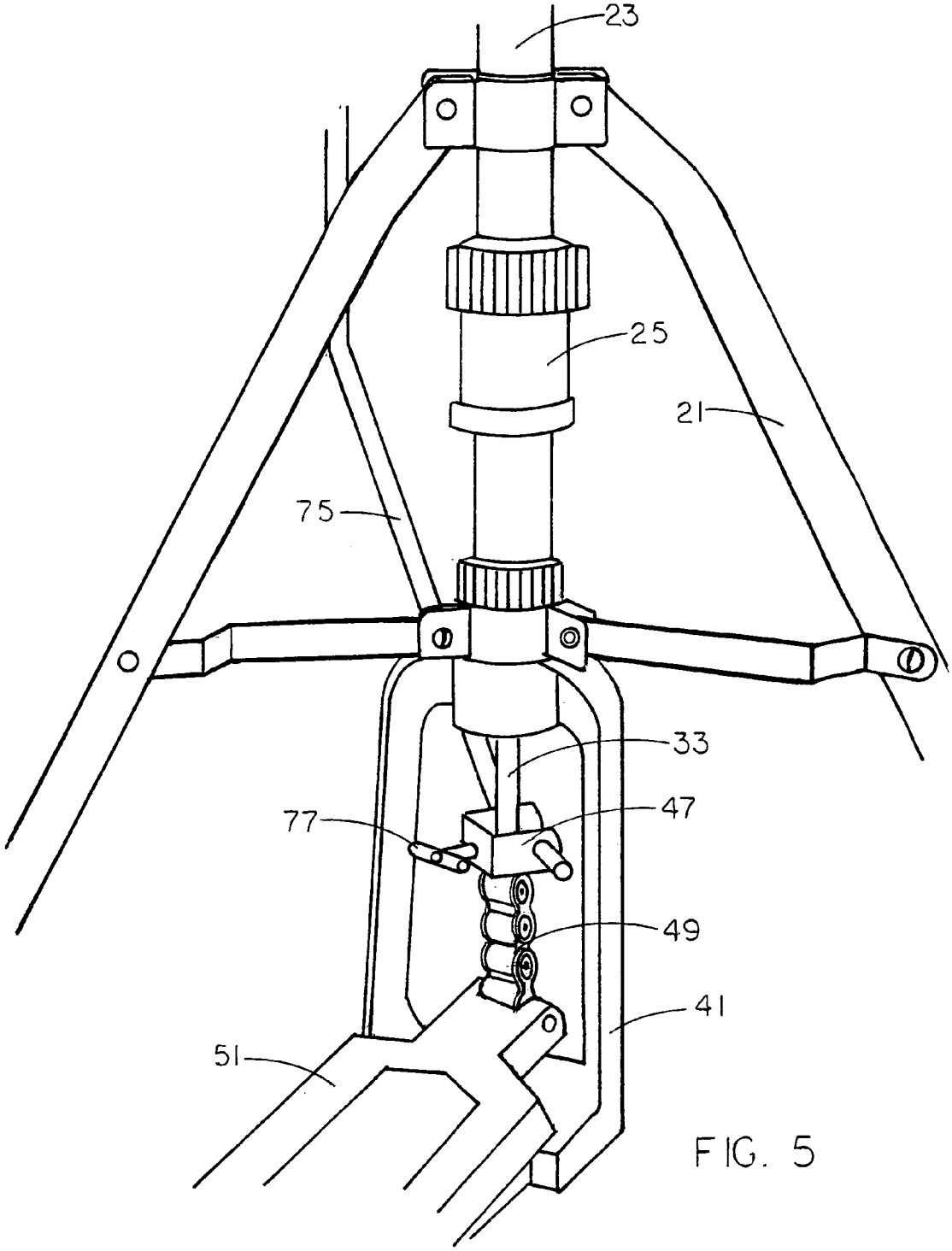
FIG. 5 is an enlarged perspective view, similar to FIG. 4, of the rear and side of the foot pedal showing the rod connected to the shaft.

A rod 75 is secured to the clamp 47 (FIG. 5). A turn screw 77 is included in the clamp 47 to permit installation and removal of the rod 75. The rod 75 is not straight like the shaft 33 but rather has an inner section 79, a middle section 81 and an outer section 83. The inner section 79 extends outwardly from the shaft 33, generally in a horizontal position at right angles to the shaft 33. The rod 75 then is bent to form the middle section 81. The outer section 83 extends generally vertically from the middle section 81 to become generally parallel to the shaft 33 and in a spaced relationship to the shaft 33. The middle section 81 is generally at a forty-five degree angle to both the outer section 83 and the inner section 79.

Figure 3:
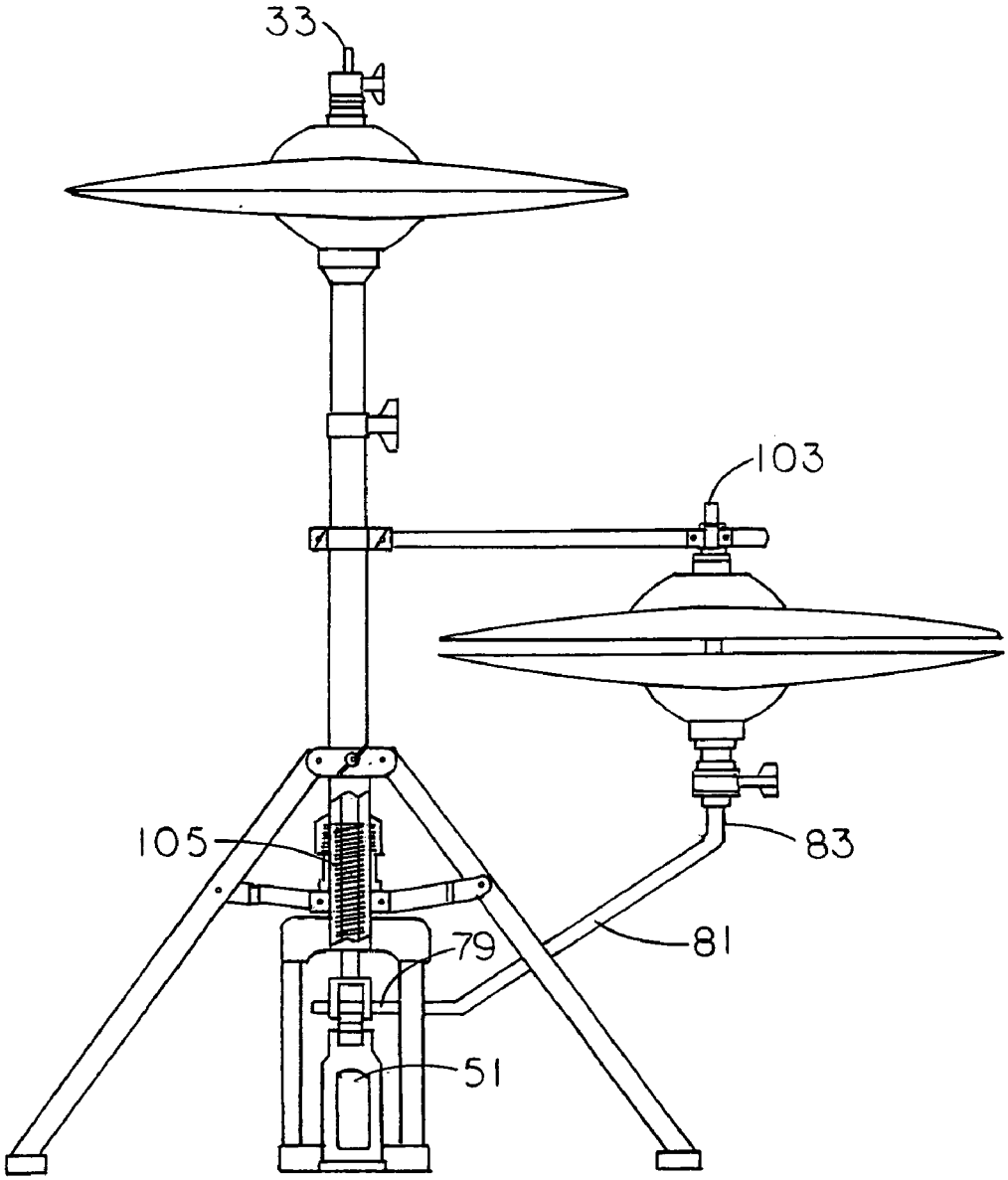
FIG. 3 is a front elevation similar to FIG. 2 but with the foot pedal depressed, the high hat pair of cymbals being closed and the alternate pair of cymbals being open.
Figure 6:
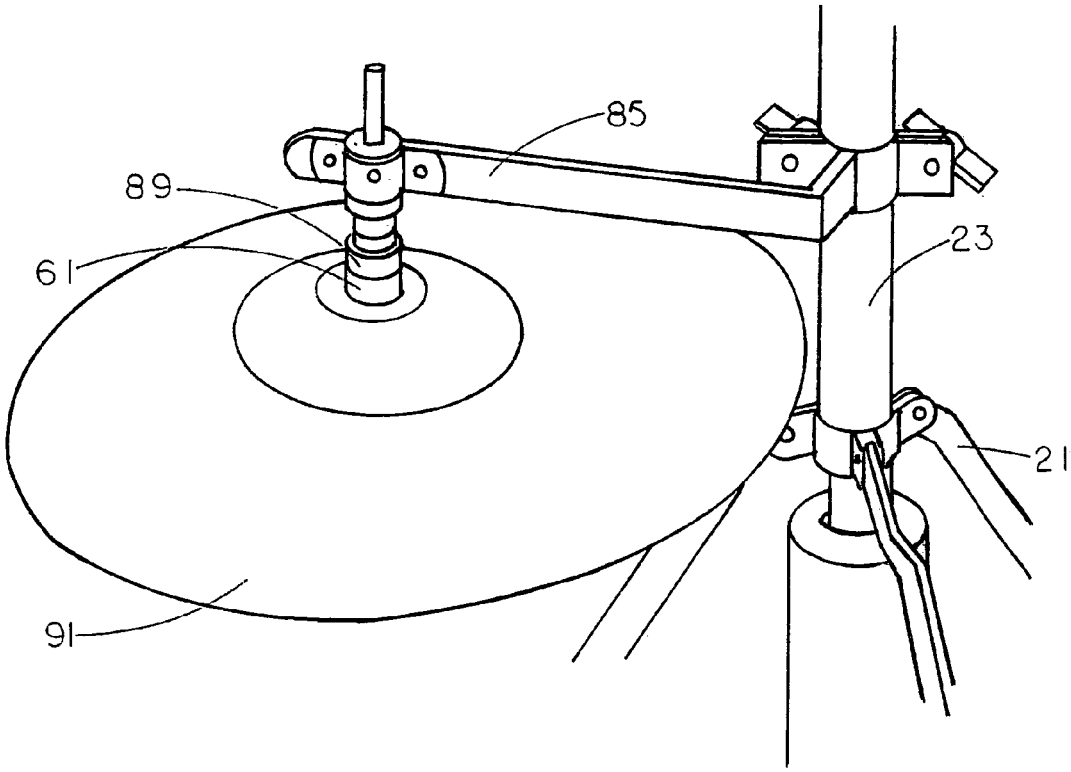
FIG. 6 is a perspective view of the alternate or second pair of cymbals and the bracket on the column of the high hat used for supporting the alternate pair of cymbals.

As best seen in FIG. 3, and FIG. 6, a bracket 85 is secured generally horizontally to the column 23. Toward the outer end 87 of the bracket 85, remote from the column 23, a pair of retainers 89 are secured to the bracket 85. A top cymbal 91 of the pair of alternate or second cymbals 19 is held by a pair of retainers 89 between a pair of felt washers 61. At the outside end 93 of the outer section 83 of the rod 75, a connector 95 is located. The connector 95 includes a turn screw 97. The connector 95 secures the rod 75 to a pair of bottom retainers 99 which hold a bottom cymbal 101 between two felt washers 61 on the rod 75. The bottom cymbal 101 of the alternate pair of cymbals 19 thus moves with the rod 75 which moves with the shaft 33. A rod extension 103 extends upwardly from the outer section 83 of the rod 75 and slides within the pair of retainers 89 holding the top cymbal 91 of the alternate cymbals 19. Therefore, as both the shaft 33 and the rod 75 move up and down, the bottom cymbal 101 of the alternate pair of cymbals 19 moves up and down to strike the top cymbal 19 of the alternate pair of cymbals 19 alternatively to the sounding of the high hat pair of cymbals 15.

Figure 2:
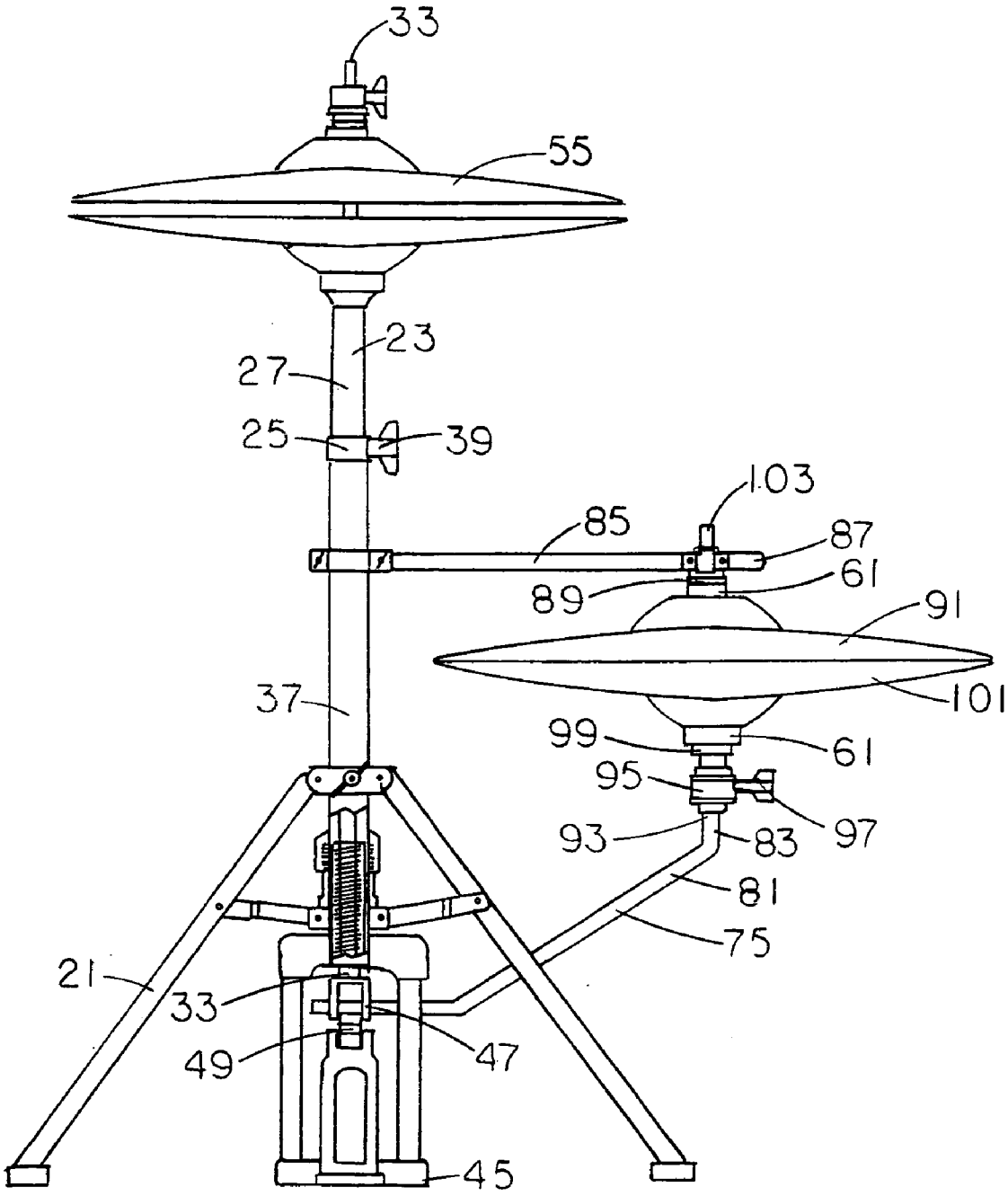
FIG. 2 is a front elevation of a high hat with the pair of cymbals of the high hat slightly separated and the alternate set of cymbals closed, one against another, the column of the high hat being cut away above the pedal to show a tension spring.

Referring to FIG. 2, the Alternating Cymbals are shown with the foot pedal 51 in the up position. With the foot pedal 51 so situated, in the upward position or non-depressed position, the top cymbal 55 and bottom cymbal 57 of the high hat pair cymbals 15 are slightly separated from one another. By contrast, the top cymbal 91 and the bottom cymbal 101 of the alternate pair of cymbals 19 are together.

Referring now to FIG. 3, the alternate pair of cymbals 19 and the high hat pair of cymbals 15 are shown with the foot pedal 51 depressed. With the foot pedal 51 depressed, the high hat pair of cymbals 15 are brought together to produce sound but the alternate pair of cymbals 19 are separated. However, when the foot pedal 51 is released, due to the action of a spring 105 about the shaft 33 (FIG. 2 and FIG. 3) the shaft 33 is forced upwardly, thereby separating the high hat pair of cymbals 15 and by the upward movement of the rod, which is connected to the shaft 33, the bottom cymbal 101 of the alternate pair of cymbals 19 strikes the top cymbal 91 of the alternate pair of cymbals 19, thus providing sound from the alternate pair of cymbals 19.

With the alternate pair of cymbals 19 connected to the high hat pair of cymbals 15, a percussionist, by one depression of the foot pedal 51, produces a initial sound from the high hat section 13 and the release of the foot pedal 51 results in an alternate sound from the alternate section 17 after, but closely following, the sound from the high hat section 13.

While a preferred embodiment is shown and described herein, it should be understood that the present disclosure is made by way of example only and that variations in the described Alternating Cymbals and its' uses are possible within the scope of the following claims, and a reasonable equivalency thereof, which claims I regard as my invention.

The invention claimed is:

1. Alternating cymbals comprising:

a first pair of cymbals including a top cymbal and a bottom cymbal;

a second pair of cymbals including a top cymbal and a bottom cymbal;

a support means for supporting both the first pair of cymbals and the second pair of cymbals, the bottom cymbal of the first pair of cymbals and the top cymbal of the second pair of cymbals being mounted on the support means and the top cymbal of the first pair of cymbals and the bottom cymbal of the second pair of cymbals being mounted to move on the support means; and actuating means for moving the top cymbal of the first pair of cymbals toward the bottom cymbal to strike the bottom cymbal of the first pair of cymbals, while moving the bottom cymbal of the second pair of cymbals away from the top cymbal of the second pair of cymbals and for moving the top cymbal of the first pair of cymbals away from the bottom cymbal of the first pair of cymbals while moving the bottom cymbal of the second pair of cymbals toward the top cymbal to strike the top cymbal of the second pair of cymbals.

2. Alternating Cymbals according to claim 1 wherein the support means includes a tripod, a column which is generally vertically oriented and is secured to the tripod and a bracket generally horizontally mounted on the column.

3. Alternating Cymbals according to claim 1 wherein the support means includes:

a tripod, a column which is generally vertically oriented secured to the tripod and a bracket generally horizontally mounted on the column: and wherein the actuation means includes a shaft mounted to slide within the column and affixed to the top cymbal of the first pair of cymbals and a rod connected to the shaft and to the bottom cymbal of the second pair of cymbals.

4. Alternating Cymbals according to claim 1 wherein the support means includes:

a tripod, a column which is generally vertically orientated secured to the tripod and a bracket generally horizontally mounted on the column; and wherein the actuation means includes a shaft having two ends mounted to slide within the column and being affixed to the top cymbal of the first pair of cymbals and a rod connected to the shaft and to the bottom cymbal of the second pair of cymbals and a foot pedal connected to the shaft at the opposite end of the shaft from the top cymbal of the first pair of cymbals, the rod being connected to the shaft adjacent to the end of the shaft where the foot pedal is located.

5. Alternating Cymbals comprising:

a first pair of cymbals, including a top cymbal and a bottom cymbal;

a support means;

a column mounted on the support means in a generally vertical position: the column having an opening extending through it vertically; the bottom cymbal of the first pair of cymbals being mounted on the column;

a shaft mounted to slide in the opening in the column and; having an upper end and a lower end, the top cymbal of the first pair of cymbals being connected to the upper end of the shaft;

means to force the shaft upwardly;

a foot pedal connected to the shaft to force the shaft upwardly;

a rod secured to the shaft; and a second pair of cymbals including a top cymbal and bottom cymbal, the bottom cymbal of the second pair of cymbals being mounted on the rod, the top cymbal of the second pair of cymbals being mounted on the support means.

6. Alternating Cymbals according to claim 5 wherein the shaft is connected to the foot pedal by a chain.

7. Alternating Cymbals according to claim 5 wherein the rod is secured to the shaft by a clamp.

8. Alternating Cymbals according to claim 5 wherein the support means for the top cymbal of the second pair of cymbals includes a bracket secured to the column.

9. Alternating Cymbals according to claim 5 wherein the rod extends horizontally from the shaft and bends from the horizontal to a generally parallel position in a spaced relationship to the shaft.

* * * * *